US005390622A

United States Patent [19]

Kishi et al.

[11] Patent Number: 5,390,622

[45] Date of Patent: Feb. 21, 1995

[54] STEERING POLE FOR JET PROPULSION BOAT

[75] Inventors: Hideki Kishi; Mitsuhisa Hirano, both of Iwata, Japan

[73] Assignee: Yamaha Hatsudoki Kabushiki Kaisha, Iwata, Japan

[21] Appl. No.: 254,479

[22] Filed: Jun. 6, 1994

Related U.S. Application Data

[63] Continuation of Ser. No. 954,897, Sep. 30, 1992, abandoned.

[30] Foreign Application Priority Data

Sep. 30, 1991 [JP] Japan ..... 3-251563

[51] Int. Cl.[6] ..... B63B 35/73

[52] U.S. Cl. ..... 114/270; 114/357

[58] Field of Search ..... 114/270, 357, 144 R; D12/307; 74/492, 493; 440/62

[56] References Cited

U.S. PATENT DOCUMENTS

| | | | |
|---|---|---|---|
| D. 233,140 | 10/1974 | Tanaka et al. | 114/270 |
| 5,036,789 | 8/1991 | Kelly et al. | 114/270 |
| 5,111,765 | 5/1992 | Kobyashi | 114/270 |

FOREIGN PATENT DOCUMENTS

| | | | |
|---|---|---|---|
| 197528 | 10/1986 | European Pat. Off. | 114/270 |
| 136390 | 5/1990 | Japan | 114/270 |
| 139490 | 6/1991 | Japan | 114/270 |

*Primary Examiner*—David A. Bucci
*Assistant Examiner*—Thomas J. Brahan
*Attorney, Agent, or Firm*—Knobbe, Martens, Olson & Bear

[57] ABSTRACT

A control mast assembly for a small watercraft formed primarily from a unitary plastic assembly comprised of a foamed core and a surrounding protective covering. In one embodiment, the core is foamed in place and in the other the protective covering is formed from a fiberglass reinforced resin laid up around the core. Upper and lower fittings formed from lightweight metal castings provide pivotal connections to the hull of the watercraft and the support for the control mechanism.

19 Claims, 5 Drawing Sheets

STEERING POLE FOR JET PROPULSION BOAT

This application is a continuation of application Ser. No. 07/954,897, filed Sep. 30, 1992, now abandoned.

BACKGROUND OF THE INVENTION

The invention relates to a steering pole for a jet propulsion boat and more particularly to an improved control mast for such a watercraft.

A very popular type of watercraft is designed to be operated by a rider who either stands, heels or sits on a deck of watercraft and controls it by means of a mast that is pivotally supported at its lower end on the front of the watercraft so as to accommodate the rider's chosen operating position. This pivotal movement occurs about a generally transversely disposed pivot axis. Such a watercraft is shown in FIG. 1 and is identified generally by the reference numeral 11.

As may be seen, the watercraft 11 is comprised of a hull 12 having a rear deck portion 13 on which a rider, indicated at 14 may be positioned at any of the desired locations. This type of watercraft is normally powered by a small jet propulsion unit which is disposed beneath the rider's deck 13. This jet propulsion unit is driven by an internal combustion engine positioned forwardly of the rider's deck 13 and beneath a hatch 15. This jet propulsion unit has a pivotally supported steering nozzle which is steered by means of a steering control or handlebar 16 positioned at the upper end of a mast 17 which, in turn, pivotally supported at its lower end on the front portion of the hatch cover 15, in a manner which will be described.

FIG. 2 is a cross sectional view taken through a control-mast constructed in accordance with a type of prior art construction and wherein the control mast is indicated generally by the reference numeral 18. The control mast 18 is comprised of a core 19 that is formed from a foam plastic material and which has a recess 21 in which a tube 22 is contained. Wire actuators (not shown) pass through the tube 22 and are connected to the steering nozzle and throttle control for the engine for controlling the watercraft 11 in a well known manner.

In accordance with the prior art types of construction, the foam material 19 is contained within a two piece protective housing comprised of pieces 23 and 24 that are formed from a more rigid plastic material such as a fiberglass reinforced plastic which form a pivot for the handlebar assembly 16 at their upper end and the pivot to the hull at their lower end. Because of these structural requirements, the housing pieces 23 and 24 are quite heavy and large. In addition, the housing pieces 23 and 24 have overlapping portions, indicated at 25 which are secured to each other in a suitable manner such as bonding or the like. In order to provide good strength, these overlapping portions 25 must have sufficient length and hence the handle assembly 18 is of the prior art type and is quite heavy and tiring for the operator to hold. In addition, the center of gravity and moment of inertia is increased due to the heavy weight of the steering mast 18, particularly when the rider 14 is standing, and this gives rise to handling problems as well as making the boat somewhat unstable and more difficult to maneuver.

Also, because of the connections to the handlebar 16 and hull 12 for pivotal movement, the upper lower ends of the steering mast 18 are normally formed to be quite thick and heavy, aggravating the aforenoted problems.

It is, therefore, a principal object of this invention to provide an improved, light weight and easily manufactured control mast for a small watercraft.

It is further object of this invention to provide an improved lightweight control mast for a small watercraft that can be easily made and which will nevertheless have the necessary strength characteristics.

SUMMARY OF THE INVENTION

This invention is adapted to be embodied in a control mast for a small watercraft or the like for attachment to a bow portion of a watercraft for pivotal movement about a transverse, horizontal axis. The mast is comprised of a plastic core defining at least in part a control cavity for containing at least one control cable for the watercraft and a unitary outer plastic covering enclosing and bonded to the core for providing a unitary assembly.

DETAILED DESCRIPTION OF THE PREFERRED EMBODIMENTS OF THE INVENTION

Figure 1:
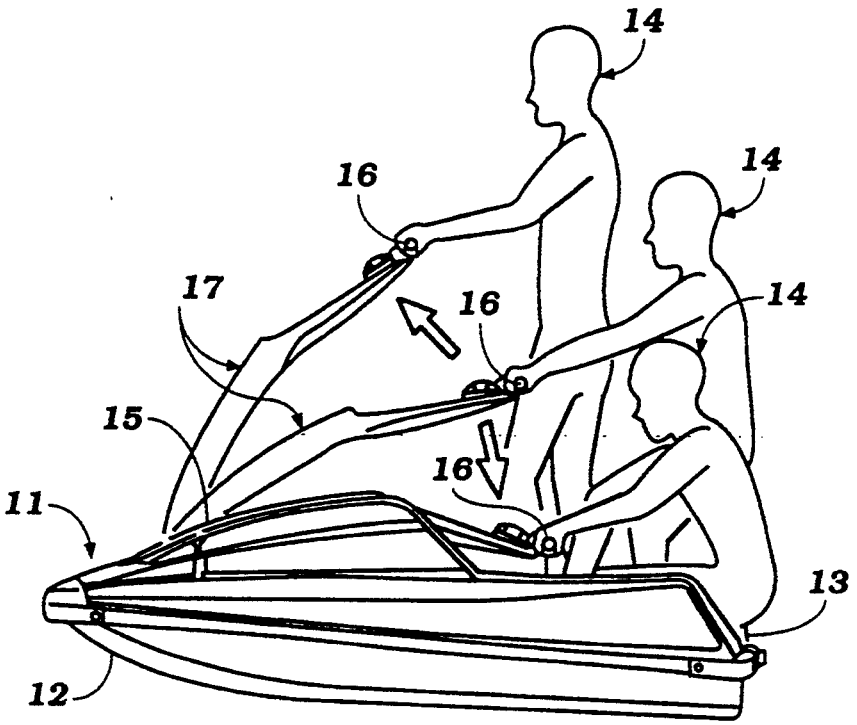
FIG. 1 is a side elevational view of a small watercraft of the type adapted to be controlled by a steering pole constructed in accordance with an embodiment of the invention.
Figure 2:
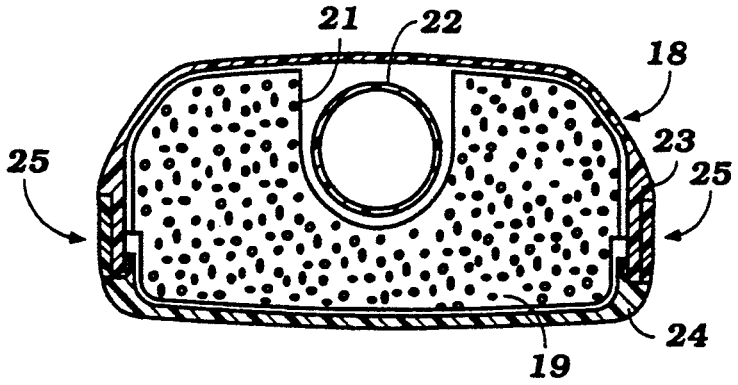
Figure 2 Prior Art
FIG. 2 is a cross sectional view taken through a steering pole or mast of a prior art type of construction.
Figure 3:
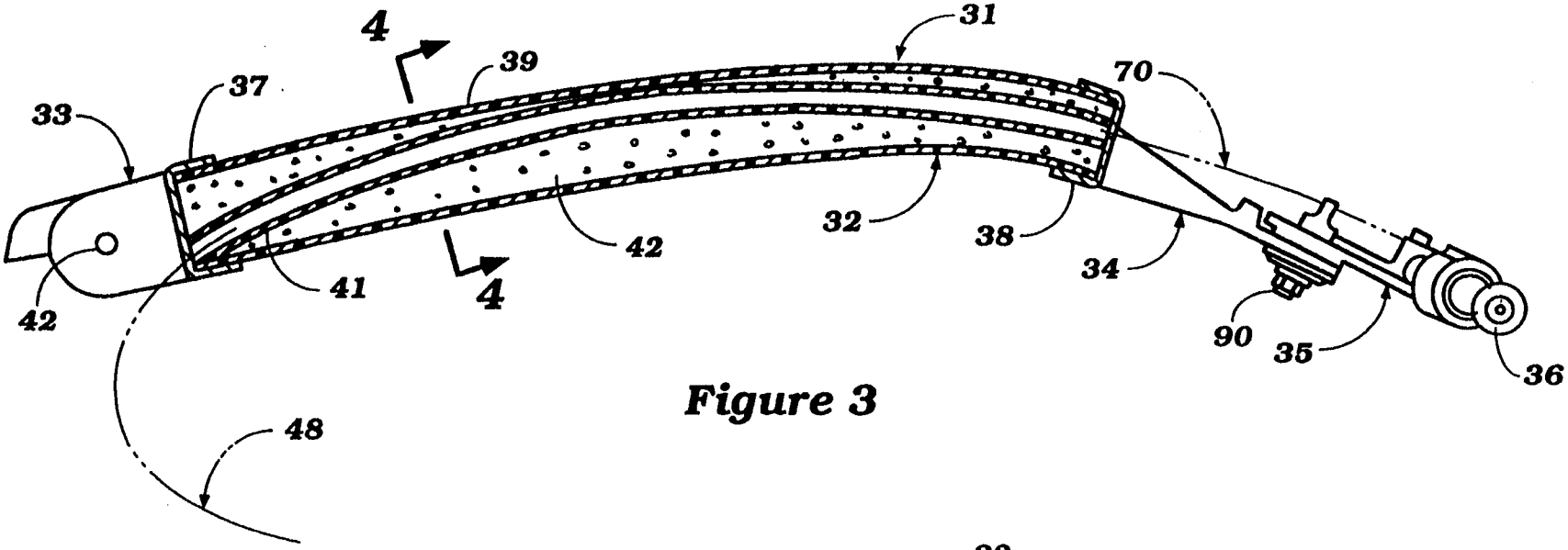
FIG. 3 is a longitudinal cross sectional view through a mast constructed in accordance with an embodiment of the invention.
Figure 4:
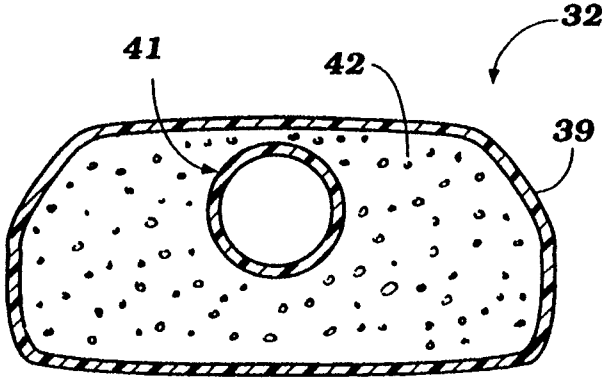
FIG. 4 is a cross sectional view, in part similar to FIG. 2, and is taken along the line 4—4 of FIG. 3 and shows this embodiment.

Referring first in detail to the embodiments of FIGS. 3 through 9, a control mast adapted to be employed with a watercraft of the type shown in FIG. 1 is identified generally by the reference numeral 31. The control mast 31 includes a main body portion 32, a lower fitting 33 which provides the pivotal connection to the hull 12 and an upper fitting 34 which carries the control assembly, indicated generally by the reference numeral 35 and including a handlebar assembly 36.

The upper and lower fittings 33 and 34 may be formed from a lightweight relatively strong material such as aluminum, aluminum alloys, titanium or titanium alloys. Each of these members have respective sockets 37 and 38 which receive the respective ends of the pole portion 32. The remaining construction of fittings 33 and 34 will be described later by reference to FIGS. 5 and 6 and 7 through 9, respectively.

The mast portion 32 is comprised of an outer housing or sheath 39 which is formed from a suitable material such as a fiberglass reinforced resinous plastic or the like and which defines an internal cavity. A control tube 41 formed from a lightweight material such as either a plastic or lightweight metal is positioned within this cavity and the surrounding area is then filled with a plastic foam material 42 which is preferably foamed in place so as to form a bond with not only the control tube 41 but also the plastic covering 39 so as to provide a very strong, lightweight unitary assembly.

Figure 5:
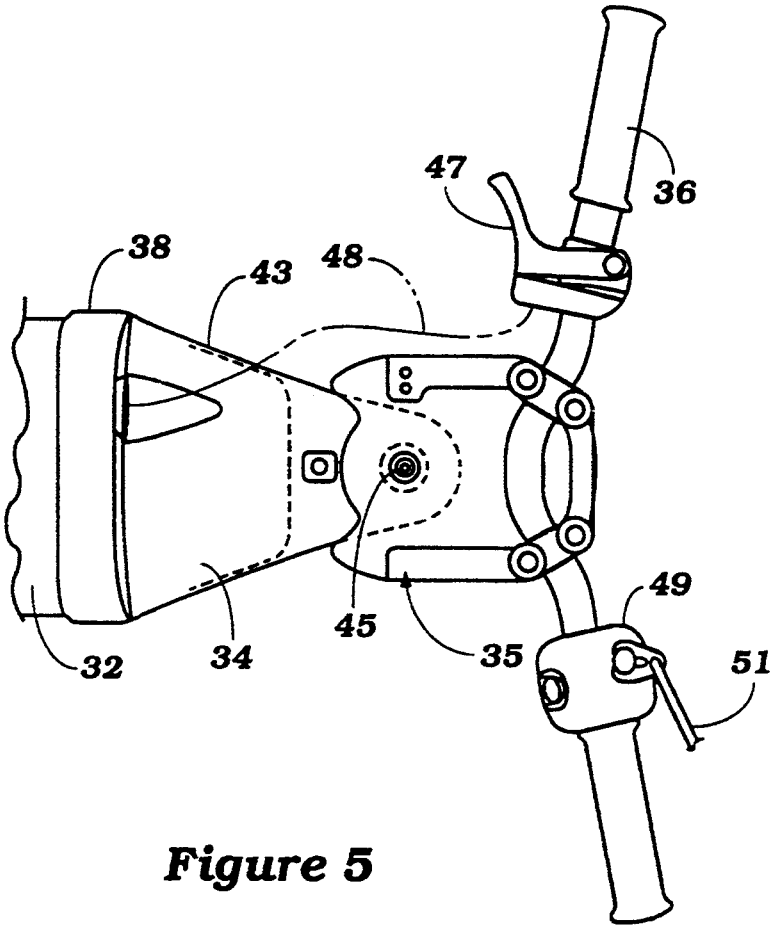
FIG. 5 is a top plan view of the upper portion of the control mast and shows how the handlebar assembly is mounted thereon.
Figure 6:
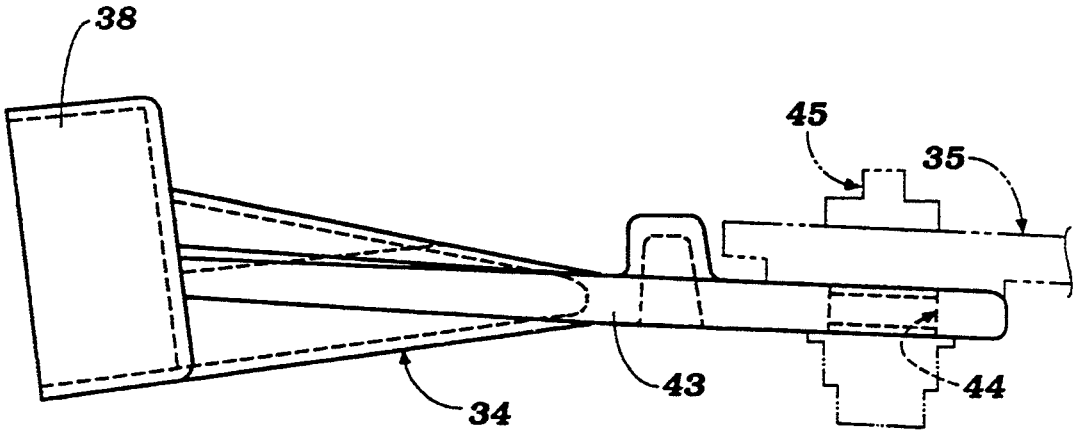
FIG. 6 is a side elevational view of the construction shown in FIG. 5.

This assembly is then fitted into the socket 38 of the fitting 34, which has a construction as will now be described by reference to FIGS. 5 and 6. This upper fitting 38, as aforenoted, has the socket portion 38 and is formed with an extending generally flat portion 43 that is formed with a bore 44 to receive a pivot bolt 45 which, in turn, connects the control assembly 35 for pivotal movement to the fitting 34 for steering movement. The control assembly 35 has one or more control cables (not shown) which are operated by its steering movement of the handlebar 36 and which extend through the control tube 41 for attachment to the steering nozzle in a well known manner. In addition, the handlebar 36 may carry a throttle control 47 which is also connected to a control cable 48 that passes through the control tube 41 and which is connected to the throttle control of the engine powering the watercraft. Because the control tube 41 is curved, as may be best seen in FIG. 3, the control cables which pass through it will not bind nor will they become chafed.

A kill switch 49 is also carried by the handlebar assembly 36 and has a wire 51 connected to the operator so as to kill the engine if the operator 14 falls off of the deck 13.

Figure 7:
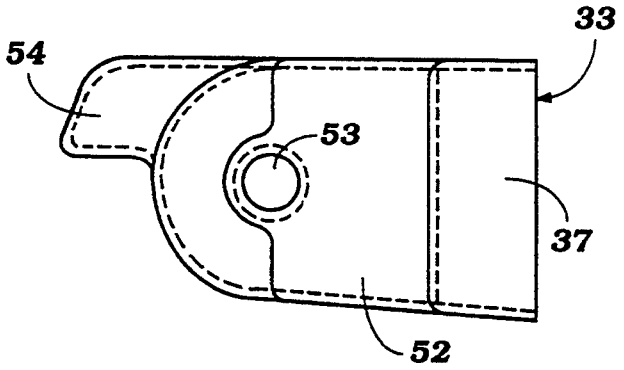
FIG. 7 is a side elevational view showing the lower attachment fitting for the control mast.
Figure 8:
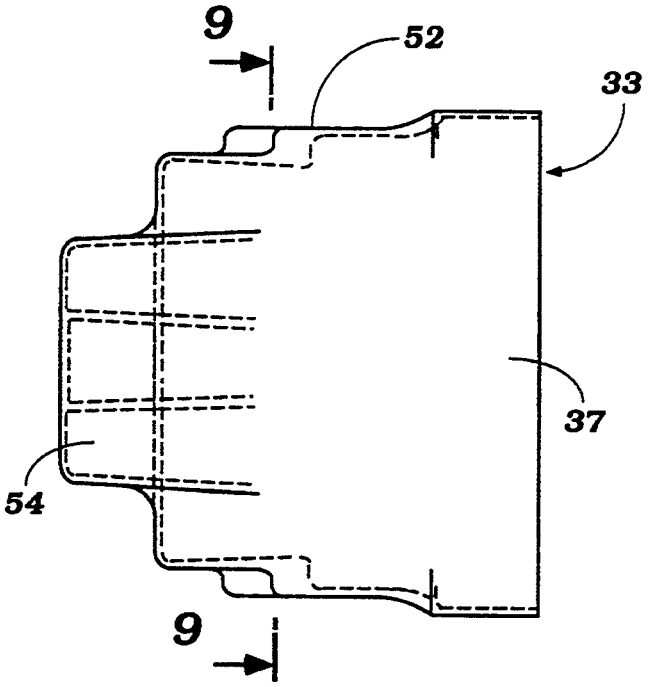
FIG. 8 is a top plan view of the lower fitting.
Figure 9:
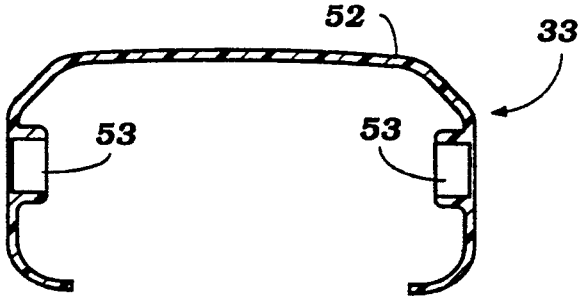
FIG. 9 is a cross sectional view taken along the line 9—9 of FIG. 8.

Referring now to FIGS. 7 through 9, the lower fitting 33, as previously noted, has the socket 37 which receives the mast portion 33. In addition, the fitting 33 has a side portion 52 which has a shape generally as shown in the figures and which defines a pair of bosses 53 to carry a cross pin (not shown) to afford the transverse, horizontal pivotal connection to the watercraft for movement between the various positions as shown in FIG. 1.

The fitting 33 also has a forwardly extending projection 54 that is adapted to contact either the hull or stop carried by it to limit the maximum degree of upward pivotal movement.

Figure 10:
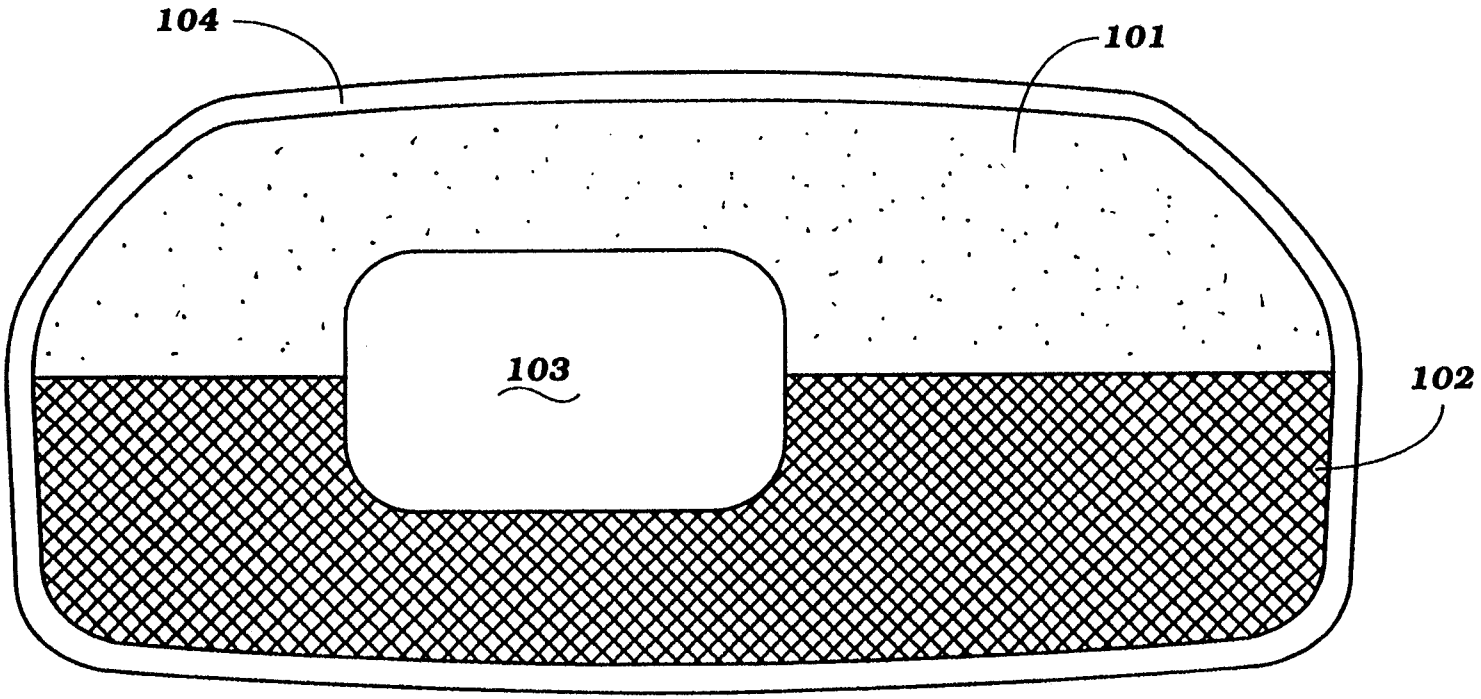
FIG. 10 is an enlarged cross section view, in part similar to FIG. 4, and shows another embodiment of the invention.

In the embodiment of the invention as thus far described, the foam core 42 has been formed by foaming it in place. FIG. 10 shows another embodiment of the invention wherein the core is formed of two pieces 101 and 102 which may be foamed separately and which together define a control cavity 103 through which control cables may extend. The cavity 103 is preferably curved for the-reasons previously described. If desired, a further insert piece may be positioned within the insert halves 101 and 102 to define a more rigid enclosure for the control cables.

The halves 101 and 102 are then placed together and are encircled by the plastic encasement 104 which may be conveniently formed by wrapping fiberglass material around it and then laying up the fiberglass with a plastic around the core 101 and 102 to form a unitary assembly with all pieces being integrally bound to each other through the forming of the encasement 104.

By using a rectangular opening 103 the steering motion of the control cable is accommodated and such a rectangular control tube may be employed with the previously described embodiment.

As may be readily seen from the foregoing description the described control masts are extremely light in weight and yet are very strong. In each embodiment, the plastic covering is of substantially uniform thickness, as clearly shown in the drawings, and is devoid of any joints. In addition, they may be made in a very low cost fashion and still will provide a very good assembly that will serve its purposes. Of course, the foregoing description is that of an improved embodiment of the invention and various changes and modifications may be made without departing from the spirit and scope of the invention, as defined by the appended claims.

We claim:

1. A watercraft having a hull, a control, and control mast for attachment to a bow portion of said watercraft for pivotal movement about a transverse, horizontal axis, said control mast being comprised of a foamed plastic core defining at least in part a control cavity for passing at least one control cable for said watercraft control, and a unitary outer plastic covering having a substantially uniform cross sectional thickness and devoid of any joints enclosing and bonded to said core for providing a unitary assembly.

2. A control mast as set forth in claim 1 wherein the foam plastic core is formed by foaming it in place within the unitary outer plastic covering.

3. A control mast as set forth in claim 2 wherein the control cavity is formed by a hole passing through the plastic core.

4. A control mast as set forth in claim 3 wherein the hole is formed by an insert around which the foam material is foamed in place around.

5. A control mast as set forth in claim 3 wherein the control cavity is curved in transverse cross sections.

6. A control mast as set forth in claim 1 wherein the outer plastic covering is formed from a molded fiberglass reinforced resin.

7. A control mast as set forth in claim 1 further including upper and lower fittings affixed to the control mast, the lower fitting providing the pivotal connection to the hull of the associated watercraft and the upper fitting pivotally supporting a control handlebar assembly.

8. A control mast as set forth in claim 7 wherein the upper and lower fittings are formed from a different material than the remainder of the control mast.

9. A control mast as set forth in claim 8 wherein the different material comprises a lightweight metal alloy.

10. A control mast as set forth in claim 9 wherein the upper and lower fittings are formed with sockets for receiving the control mast.

11. A control mast as set forth in claim 10 wherein the foam plastic core is formed by foaming it in place within the unitary outer plastic covering.

12. A control mast as set forth in claim 11 wherein the control cavity is formed by a hole passing through the plastic core.

13. A control mast as set forth in claim 12 wherein the hole is formed by an insert around which the foam material is foamed in place around.

14. A control mast as set forth in claim 12 wherein the control cavity is curved in transverse cross sections.

15. A control mast as set forth in claim 10 wherein the outer plastic covering is formed from a molded fiberglass reinforced resin.

16. A control mast as set forth in claim 15 wherein the plastic covering is laid up around the core.

17. A control mast as set forth in claim 16 wherein the core is formed from a two piece construction and wherein the two pieces when fixed to each other define the control cavity.

18. A control mast for attachment to a bow portion of a watercraft for pivotal movement about transverse, horizontal axis, said control mast being comprised of a plastic core defining at least in part a control cavity for passing at least one control cable for said watercraft, and a unitary outer plastic covering enclosing and bonded to said core for providing a unitary assembly laid up around said core.

19. A control mast as set forth in claim 18 wherein the core is formed from a two piece construction and wherein the two pieces when fixed to each other define the control cavity.

* * * * *